US008054274B2

(12) United States Patent
Chen

(10) Patent No.: US 8,054,274 B2
(45) Date of Patent: Nov. 8, 2011

(54) LIQUID CRYSTAL DISPLAY DEVICE HAVING CONTROLLING CIRCUIT FOR ADJUSTING COMMON VOLTAGE

(75) Inventor: Hung-Yu Chen, Miao-Li (TW)

(73) Assignee: Chimei Innolux Corporation, Miao-Li County (TW)

( * ) Notice: Subject to any disclaimer, the term of this patent is extended or adjusted under 35 U.S.C. 154(b) by 800 days.

(21) Appl. No.: 12/151,829

(22) Filed: May 9, 2008

(65) Prior Publication Data

US 2008/0278429 A1 Nov. 13, 2008

(30) Foreign Application Priority Data

May 9, 2007 (CN) ..... 2007 1 0074346

(51) Int. Cl.
*G09G 3/36* (2006.01)

(52) U.S. Cl. ..... 345/96; 345/98

(58) Field of Classification Search ..... 345/92, 345/98, 96

See application file for complete search history.

(56) References Cited

U.S. PATENT DOCUMENTS

| | | | | |
|---|---|---|---|---|
| 5,561,442 | A | 10/1996 | Okada et al. | |
| 7,773,104 | B2 * | 8/2010 | Chang et al. | 345/690 |
| 2001/0043187 | A1 * | 11/2001 | Ikeda | 345/100 |
| 2004/0169627 | A1 * | 9/2004 | Hong | 345/89 |
| 2007/0146260 | A1 * | 6/2007 | Kang | 345/87 |
| 2008/0024417 | A1 * | 1/2008 | Huang et al. | 345/98 |
| 2008/0074366 | A1 * | 3/2008 | Drader et al. | 345/87 |

* cited by examiner

*Primary Examiner* — Chanh Nguyen
*Assistant Examiner* — John Kirkpatrick
(74) *Attorney, Agent, or Firm* — Altis Law Group, Inc.

(57) ABSTRACT

An exemplary liquid crystal display device includes a liquid crystal panel configured for displaying images according to external image data. The liquid crystal panel comprising a plurality of sub-pixel regions and a controlling circuit. The sub-pixel regions are arranged regularly, each of the sub-pixel regions having either a positive polarity or a negative polarity when displaying images. The controlling circuit is configured to adjust a common voltage applied to the liquid crystal panel according to a relationship between variations of the common voltage and polarity information of at least a plurality of the sub-pixel regions during operation of the liquid crystal display device.

11 Claims, 4 Drawing Sheets

LIQUID CRYSTAL DISPLAY DEVICE HAVING CONTROLLING CIRCUIT FOR ADJUSTING COMMON VOLTAGE

FIELD OF THE INVENTION

The present invention relates to liquid crystal display (LCD) devices that can adjust common voltages, and more particularly to an LCD device having a controlling unit for adjusting the common voltage.

BACKGROUND

Because LCD devices have the advantages of portability, low power consumption, and low radiation, they have been widely used in various portable information products such as notebooks, personal digital assistants (PDAs), video cameras, and the like. Furthermore, LCD devices are considered by many to have the potential to completely replace cathode ray tube (CRT) monitors and televisions.

Referring to FIG. 4, a typical LCD device 10 includes a gate driving circuit 11, a data driving circuit 12, and a liquid crystal panel 101. The gate driving circuit 11 is configured for providing a plurality of scanning signals to the liquid crystal panel 101. The data driving circuit 12 is configured for receiving image data from an external source, and providing a plurality of gray scale voltages to the liquid crystal panel 101 accordingly.

The liquid crystal panel 101 includes a plurality of parallel scanning lines 13, a plurality of parallel data lines 14, a plurality of thin film transistors (TFTs) 15, a plurality of sub-pixel electrodes 151, and a plurality of common electrodes 152. The gate lines 13 and the data lines 14 cross each other and cooperatively define a plurality of sub-pixels 16 arranged in a matrix. The liquid crystal panel 101 also includes a layer of liquid crystal spanning the entire matrix. The liquid crystal contains liquid crystal molecules.

The TFTs 15 are arranged in a matrix respectively corresponding to the sub-pixels 16. Each TFT 15 includes a gate electrode (not labeled) connected to the corresponding gate line 13, a source electrode (not labeled) connected to the corresponding data line 14, and a drain electrode (not labeled) connected to a corresponding sub-pixel electrode 151. Each sub-pixel electrode 151 is opposite to a corresponding common electrode 152. All the common electrodes 152 are substantially connected to a common voltage source (not labeled), which has a predetermined common voltage applied thereto.

The sub-pixels 16 includes a plurality of red sub-pixels (R), a plurality of green sub-pixels (G), and a plurality of blue sub-pixels (B), which are arranged in a pattern of repeating RGB sequences in each row of the matrix.

Generally, when the LCD device 10 displays images, the common electrode 152 has the predetermined common voltage applied thereto, and the sub-pixel electrode 151 has a gray scale voltage applied thereto. Thus, an electric field is generated in the area of the liquid crystal molecules at each sub-pixel 16. A transmittance of light passing through the liquid crystal molecules is adjusted by controlling the strength of the electric field. Thereby, the desired transmittances of light obtained at all the sub-pixels 16 cooperatively produces an image viewed by a user of the LCD device 10.

Referring to FIG. 5, this is a schematic diagram of part of a testing image 30 for the LCD device 10. At each sub-pixel 16, the liquid crystal molecules in the electrical field are twisted such that light rays are allowed to pass through the sub-pixel 16. When the gray scale voltage is greater than the common voltage, the direction of the electrical field is from the sub-pixel electrode 151 to the common electrode 152, and the sub-pixel 16 has a positive polarity (+). Conversely, when the gray scale voltage is less than the common voltage, the direction of the electrical field is from the common electrode 152 to the sub-pixel electrode 151, and the sub-pixel 16 has a negative polarity (−). Moreover, when absolute values of the gray scale voltages applied to the sub-pixel electrodes 151 of two sub-pixels 16 are the same, and the gray scale voltages only differ in polarity, the gray scales of the two sub-pixels 16 are assumed to be the same. The liquid crystal panel 10 is a normal white mode panel. That is, the greater the gray scale voltage applied, the less the amount of light rays that can pass through the corresponding sub-pixel 16. When the gray scale voltage is great enough, the light rays cannot pass through the corresponding sub-pixel 16.

As shown in FIG. 5, each small square represents a sub-pixel 16. Each sub-pixel 16 has a polarity different from the polarity of the two adjacent sub-pixels 16 in the same row, and different from the polarity of the two adjacent sub-pixels 16 in the same column. Furthermore, squares that are not hatched represent sub-pixels 16 that have no light passing therethrough. When the testing image 30 is displayed, in the first row of sub-pixels 16, there are eight sub-pixels 16 having positive polarity that no light rays can pass through and ten sub-pixels 16 having negative polarity that no light rays can pass through. Therefore, among the sub-pixels 16 in the first row that having no light rays passing through, an amount of the sub-pixels 16 having positive polarity is less than an amount of the sub-pixels 16 having negative polarity. When the gray scale voltages are applied to the sub-pixels 16 in the first row which have no light rays passing therethrough, the gray scale voltages applied to the corresponding sub-pixel electrodes 151 are liable to drag down the common voltage of the first row of sub-pixels 16 due to a coupling effect. Thus, actual common voltages of the common electrodes 152 corresponding to the first row of sub-pixels 16 are slightly less than the predetermined common voltage.

Accordingly, the actual common voltages corresponding to other common electrodes 152 are dragged down or up immediately the gray scale voltages are applied to the corresponding sub-pixel electrodes 151, thereby generating common voltage variations.

Because the actual common voltages are not equal to the predetermined common voltage, the testing image 30 may be impaired by a so-called crosstalk phenomenon. That is, the testing image 30 may be visibly flawed. Further, when ordinary images are displayed, crosstalk may also occur when actual common voltages are not equal to the predetermined common voltage.

What is needed, therefore, is an LCD device that can overcome the above-described deficiencies.

SUMMARY

An exemplary liquid crystal display device includes a liquid crystal panel configured for displaying images according to external image data. The liquid crystal panel comprising a plurality of sub-pixel regions and a controlling circuit. The sub-pixel regions are arranged regularly, each of the sub-pixel regions having either a positive polarity or a negative polarity when displaying images. The controlling circuit is configured to adjust a common voltage applied to the liquid crystal panel according to a relationship between variations of the common voltage and polarity information of at least a plurality of the sub-pixel regions during operation of the liquid crystal display device.

Other novel features and advantages will become more apparent from the following detailed description when taken in conjunction with the accompanying drawings.

DETAILED DESCRIPTION OF PREFERRED EMBODIMENTS

Figure 1:
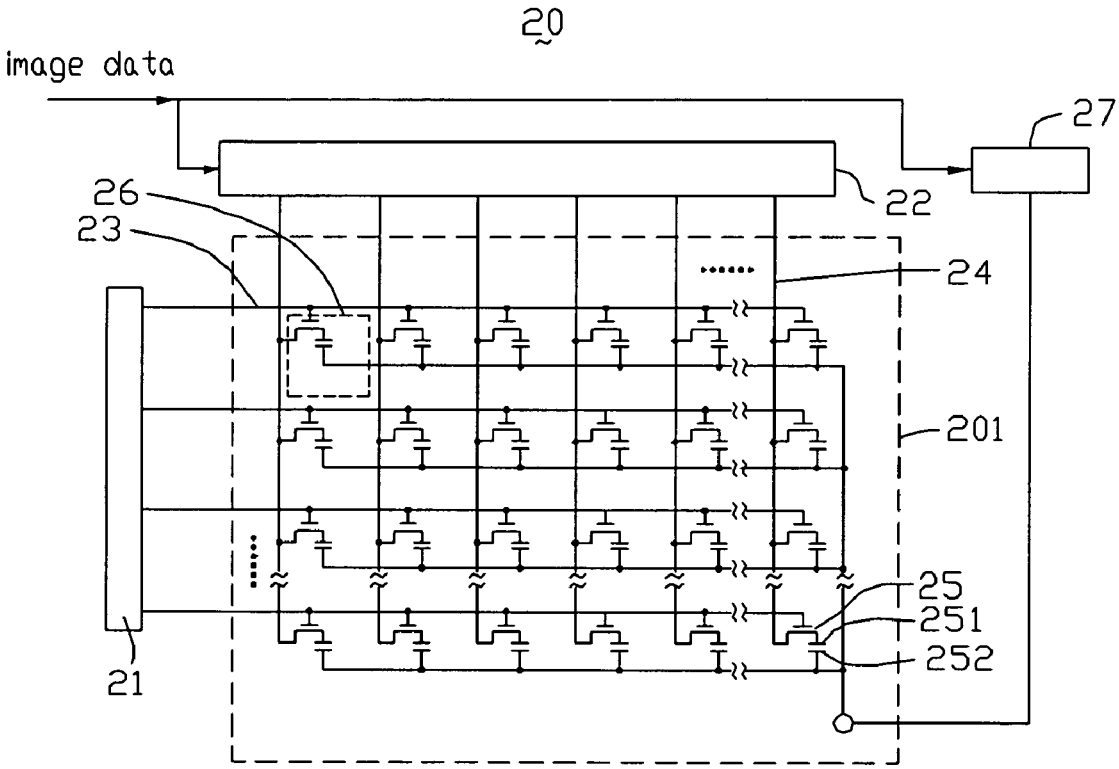
FIG. 1 is essentially an abbreviated circuit diagram of an LCD device according to an exemplary embodiment of the present invention, the LCD device including a controlling circuit.

Referring to FIG. 1, an LCD device 20 according to an exemplary embodiment is shown. The LCD device 20 includes a liquid crystal panel 201, a gate driving circuit 21, a data driving circuit 22, and a controlling circuit 27.

The liquid crystal panel 201 includes a plurality of scanning lines 23 parallel to each other, a plurality of data lines 24 parallel to each other and orthogonal to the scanning lines 23, a plurality of thin film transistors (TFTs) 25, a plurality of pixel electrodes 251, and a plurality of common electrodes 252 opposite to the pixel electrodes 251, respectively. The TFTs 25 are arranged in the vicinity of points of intersection of the scanning lines 23 and data lines 24. The common electrodes 252 are substantially connected to the controlling circuit 27. A predetermined common voltage from a common voltage source is applied to the common electrodes 252. The liquid crystal panel 201 also includes a layer of liquid crystal spanning the entire matrix. The liquid crystal contains liquid crystal molecules.

Each TFT 25 includes a gate electrode (not labeled) connected to one corresponding scanning line 23, a source electrode (not labeled) connected to one corresponding data line 24, and a drain electrode (not labeled) connected to one corresponding pixel electrode 251.

The gate driving circuit 21 is configured for providing a plurality of scanning signals to the scanning lines 23. The data driving circuit 22 is configured for receiving external digital signals, converting the digital signal into analog signals, and applying the analog signals to the data lines 24. The controlling circuit 27 is configured for receiving the external digital signals, and adjusting the common voltage applied to the common electrodes 252 according to the external digital signals.

A minimum area defined by adjacent two scanning lines 23 and adjacent two data lines 24 is defined as a sub-pixel region 26. Each sub-pixel region 26 corresponds to a TFT 25 and a pixel electrode 251. The sub-pixel regions 26 are arranged in a matrix.

When the LCD device 20 displays images, at each sub-pixel region 26, the common electrode 252 has the predetermined common voltage applied thereto, and the pixel electrode 27 has a gray scale voltage applied thereto. Thus, an electric field is generated in the area of the liquid crystal molecules. A transmittance of light passing through the liquid crystal molecules is adjusted by controlling the strength of the electric field. Thereby, the desired transmittances of light obtained at all the sub-pixel regions 26 cooperatively produces an image viewed by a user of the LCD device 20.

The liquid crystal molecules in the electrical field are twisted such that light rays are allowed to pass through. When the gray scale voltage is greater than or equal to the common voltage, the direction of the electrical field is from the pixel electrode 251 to the common electrode 252, and the sub-pixel region 26 has a positive polarity (+). Conversely, when the gray scale voltage is less than the common voltage, the direction of the electrical field is from the common electrode 252 to the pixel electrode 251, and the sub-pixel region 26 has a negative polarity (−). Moreover, when absolute values of the gray scale voltages applied to the pixel electrodes 251 of two sub-pixel regions 26 are the same, and the gray scale voltages only differ in polarity, the gray scales of the two pixels 16 are assumed to be the same. The liquid crystal panel 201 is a normally white mode panel. That is, the greater the gray scale voltage applied, the less the amount of light rays that can pass through the corresponding sub-pixel region 26. When the gray scale voltage is great enough, the light rays cannot pass through the corresponding sub-pixel region 26.

Figure 2:
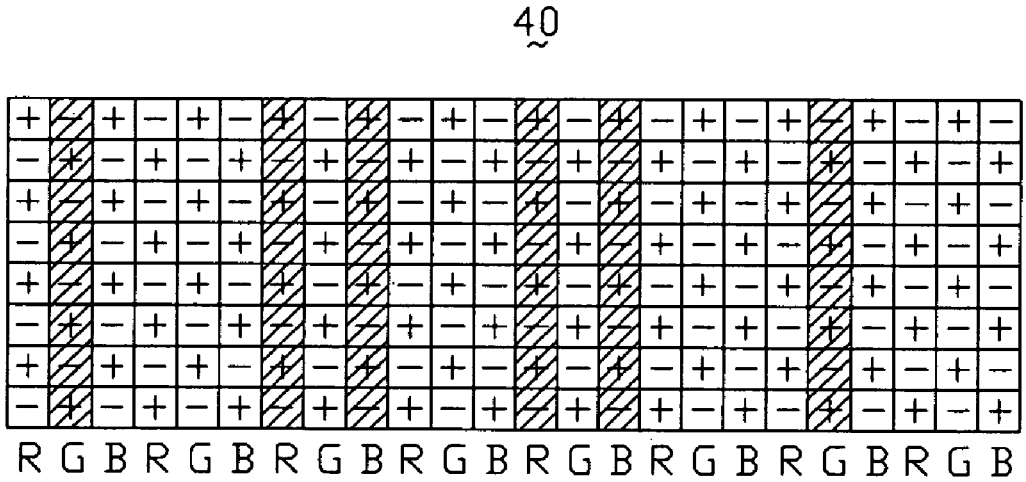
FIG. 2 is a schematic view of part of a testing image displayed by the LCD device of FIG. 1.

Referring to FIG. 2, this is a schematic view of part of a testing image 40 for the LCD device 20. Each small square represents a sub-pixel region 26. The sub-pixel regions 26 include a plurality of red sub-pixel regions (R), a plurality of green sub-pixel regions (G), and a plurality of blue sub-pixel regions (B). The sub-pixel regions 26 in each row of the matrix are arranged in a pattern of repeating RGB sequences, and the sub-pixel regions 26 in each column of the matrix display a same color of red, green or blue. In FIG. 2, "+" represents a positive polarity and "−" represents a negative polarity. Furthermore, squares that are not hatched represent pixels 26 that have no light passing therethrough.

Figure 3:
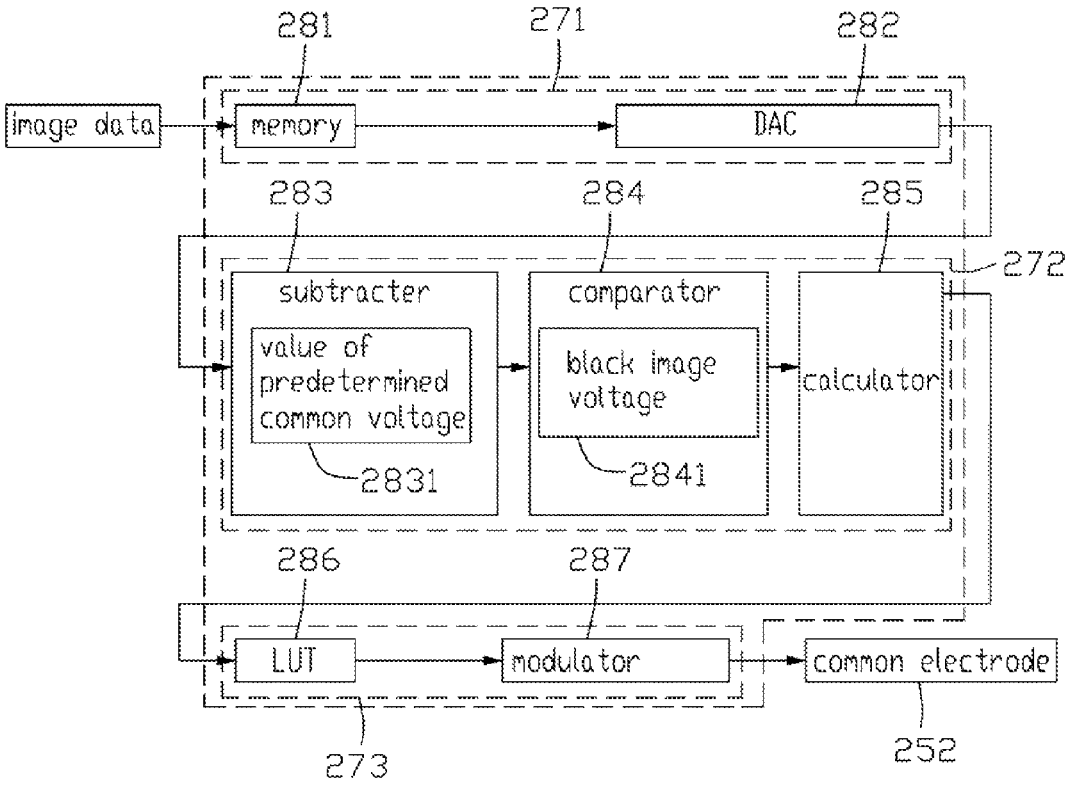
FIG. 3 is a diagram of the controlling circuit of FIG. 1.
Figure 4:
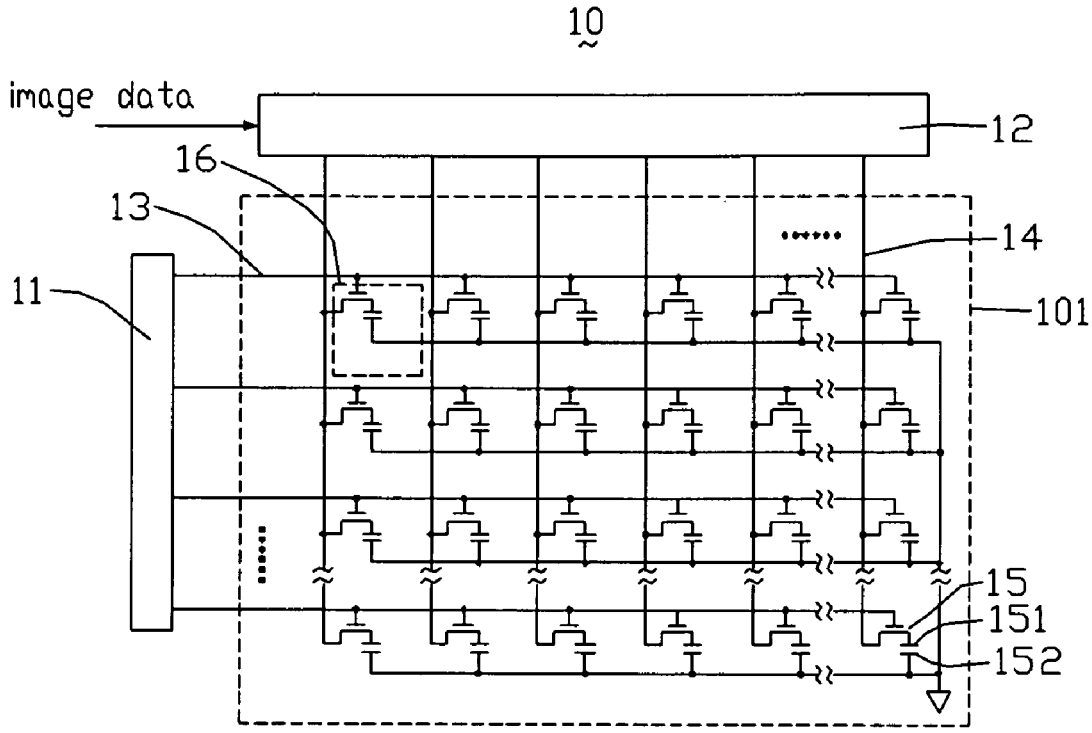
FIG. 4 (RELATED ART)
FIG. 4 is essentially an abbreviated circuit diagram of a conventional LCD device.
Figure 5:
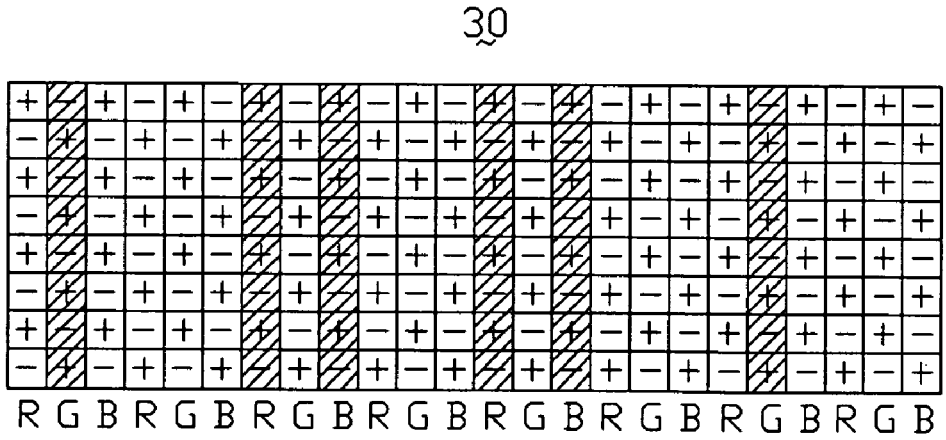
FIG. 5 (RELATED ART)
FIG. 5 is a schematic view of part of a testing image displayed by the LCD device of FIG. 4.

Referring also to FIG. 3, a schematic diagram of the controlling circuit 27 is shown. The controlling circuit 27 includes a receiving unit 271, an analyzing unit 272, and an adjusting unit 273 connected in series. The receiving unit 271 is configured for receiving the external digital image data, and outputting corresponding voltage signals. The analyzing unit 272 is configured for calculating polarity information of the sub-pixel regions 26 in each row according to the voltage signals. The adjusting unit 273 is configured for adjusting the common voltage applied to the common electrodes 252 according to the polarity information.

The receiving unit 271 includes a memory 281, and a digital to analog converter (DAC) 282. The analyzing unit 272 includes a subtracter 283, a comparator 284, and a calculator 285. The adjusting unit 273 includes a look-up table (LUT) 286 and a modulator 287.

The memory 281 receives the external digital image signals, and stores the received digital signals. The DAC 282 converts the digital signals to corresponding voltage signals, and sends the voltage signals to the subtracter 283.

The subtracter 283 stores the value of the predetermined common voltage 2831 and subtracts the value of the predetermined common voltage 2831 from the values of voltage signals respectively. The absolute values of the results are defined as comparing voltages.

The comparator 284 compares the comparing voltages to a black image voltage 2841. When the comparing voltage is equal to or greater than the black image voltage 2841, the corresponding sub-pixel regions 26 have no light rays passing through.

The calculator 285 calculates polarity information relating to the polarities of the sub-pixel regions 26 in each row which have no light rays passing therethrough. Taking the first row of the testing image 40 as an example, an amount of the sub-pixel regions 26 that having no light rays passing through and having positive polarities is eight, and an amount of the sub-pixel regions 26 that having no light rays passing through and having negative polarities is ten, thus the polarity information of the sub-pixel regions 26 in the first row is 8+(−10) =−2. The polarity information of each other row is calculated in a same way, and is stored in the adjusting unit 273. The polarity information for each row substantially corresponds to a voltage variation of the common voltage of the corresponding row.

The LUT 286 includes a pre-stored relationship between voltage variations and polarity information. The relationship can be measured and generated during a stage in the manufacture of the LCD device 20. The LUT 286 receives polarity information from the calculator 285, and sends corresponding voltage variations to the modulator 287. The modulator 287 adjusts the common voltage applied to the common electrodes 252 according to the voltage variation, and the gray scale voltages are applied to the sub-pixel regions 26 simultaneously. That is, an actual common voltage of the common electrode 252 at each sub-pixel region 26 is adjusted in accordance with the voltage variation. For example, if the common voltage applied to the common electrode 252 is understood to ordinarily be slightly dragged up due to the coupling effect, the modulator 287 applies a negative voltage corresponding to the variation of the dragging up in order to cancel out the common voltage variation.

Because the controlling circuit 27 of the LCD device 20 can adjust the common voltage applied to the common electrode 252, common voltage variation or ripple can be reduced or even eliminated. Accordingly, image crosstalk of the LCD device 20 can be reduced or even eliminated.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A liquid crystal display device comprising:

a liquid crystal panel configured for displaying images according to external image data, the liquid crystal panel comprising a plurality of sub-pixel regions arranged in a regular array, each of the sub-pixel regions having either a positive polarity or a negative polarity when displaying images; and a controlling circuit configured for adjusting a common voltage applied to the liquid crystal panel;

wherein the controlling circuit is configured to adjust the common voltage applied to the liquid crystal panel according to a relationship between variations of the common voltage and polarity information of at least the plurality of the sub-pixel regions during operation of the liquid crystal display device, and comprises a receiving unit, an analyzing unit, and an adjusting unit connected in series, the receiving unit is configured for receiving the external digital image data and outputting corresponding voltage signals, the analyzing unit is configured for calculating out the polarity information of the sub-pixel regions in each row according to the voltage signals, the adjusting unit is configured for adjusting the common voltage applied to the common electrodes according to the polarity information, the receiving unit comprises a memory and a digital to analog converter connected to the memory, the memory is configured for receiving the external image data and the digital to analog converter is configured for converting the image signals to voltage signals, the analyzing unit comprises a subtracter, a comparator, and a calculator, the subtracter is configured for subtracting the value of the common voltage from the values of the voltage signals, respectively, the comparator is configured for comparing said subtracting results to a predetermined black image voltage which is defined as a voltage corresponding to a black image, and the calculator is configured for calculating the polarity information of the sub-pixels in each row according to comparing results that are output by the comparator.

2. The liquid crystal display device of claim 1, wherein the adjusting unit comprises a look-up table and a modulator, the look-up table being configured sending a corresponding voltage variation to the modulator on receiving the polarity information.

3. The liquid crystal display device of claim 2, wherein the relationship of the voltage variations and polarity information is pre-stored in the look-up table.

4. The liquid crystal display device of claim 1, wherein the liquid crystal panel further comprises a plurality of scanning lines parallel to each other, a plurality of data lines parallel to each other and orthogonal to the scanning lines, adjacent two scanning lines and adjacent two data lines cooperatively defining one sub-pixel region, the sub-pixel regions being formed in a matrix.

5. The liquid crystal display device of claim 4, wherein the liquid crystal panel further comprises a plurality of thin film transistors arranged at vicinity of intersections of the scanning lines and the data lines, a plurality of pixel electrodes corresponding to the thin film transistors, and a plurality of common electrodes corresponding to the pixel electrodes, each sub-pixel region corresponding to one thin film transistor and one pixel electrode.

6. The liquid crystal display device of claim 5, wherein each thin film transistor comprises a gate electrode connected to one corresponding scanning line, a source electrode connected to one corresponding data line, and a drain electrode connected to one corresponding pixel electrode.

7. The liquid crystal display device of claim 4, further comprising a gate driving circuit configured for providing a plurality of scanning signals to the scanning lines, and a data driving circuit configured for receiving the external image data and providing a plurality of corresponding gray scale voltages to the data lines.

8. A liquid crystal display device comprising:

a liquid crystal panel comprising:

a plurality of scanning lines parallel to each other;

a plurality of data lines parallel to each other and orthogonal to the scanning lines, the scanning lines and the data lines cooperatively defining a plurality of sub-pixels arranged in a matrix;

a plurality of thin film transistors arranged in the vicinity of intersections of the scanning lines and the data lines, respectively;

a plurality of pixel electrodes corresponding to the thin film transistors respectively; and a plurality of common electrodes opposite to the pixel electrodes and being capable of being provided with a common voltage, respectively;

a gate driving circuit configured for providing a plurality of scanning signals to the scanning lines;

a data driving circuit configured for providing a plurality of gray scale voltages to the pixel electrodes via the data lines and the thin film transistors; and a controlling circuit configured for adjusting the common voltage applied to the common electrodes;

wherein the controlling circuit is capable of adjusting the common voltage applied to the liquid crystal panel according to a relationship between variations of the common voltage and polarity information of at least the plurality of the sub-pixels during operation of the liquid crystal display device, the controlling circuit comprises a receiving unit, an analyzing unit, and an adjusting unit connected in series, the receiving unit is configured for receiving the external digital image data and outputting corresponding voltage signals, the analyzing unit is configured for calculating the polarity information of the sub-pixels in each row according to the voltage signals, the adjusting unit is configured for adjusting the common voltage applied to the common electrodes according to the polarity information, the receiving unit comprises a memory and a digital to analog converter connected to the memory, the memory is configured for receiving the external image data, the digital to analog converter is configured for converting the image signals to voltage signals, the analyzing unit comprises a subtracter, a comparator, and a calculator, the subtracter is configured for subtracting the value of the common voltage from the values of the voltage signals, respectively, the comparator is configured for comparing said subtracting results to a predetermined black image voltage which is defined as a voltage corresponding to a black image, and the calculator is configured for calculating the polarity information of the sub-pixels in each row according to comparing results that are output by the comparator.

9. The liquid crystal display device in claim 8, wherein the adjusting unit comprises a look-up table and a modulator, the look-up table being configured for sending a corresponding voltage variation to the modulator on receiving the polarity information.

10. The liquid crystal display device in claim 9, wherein the relationship of the voltage variations and polarity information is pre-stored in the look-up table.

11. The liquid crystal display device in claim 8, wherein each two adjacent scanning lines and each two adjacent data lines cooperatively define one sub-pixel region of the matrix.

* * * * *